US010357420B2

(12) United States Patent
Unbescheiden et al.

(10) Patent No.: US 10,357,420 B2
(45) Date of Patent: Jul. 23, 2019

(54) NOZZLE CARRIER DRIVE ARRANGEMENT FOR A WATER JET MASSAGING APPARATUS

(71) Applicant: UNBESCHEIDEN GMBH, Baden-Baden (DE)

(72) Inventors: Heinrich Unbescheiden, Rastatt (DE); Mark Unbescheiden, Buehlertal (DE)

(73) Assignee: UNBESCHEIDEN GMBH, Baden-Baden (DE)

( * ) Notice: Subject to any disclaimer, the term of this patent is extended or adjusted under 35 U.S.C. 154(b) by 428 days.

(21) Appl. No.: 15/357,776

(22) Filed: Nov. 21, 2016

(65) Prior Publication Data

US 2018/0140507 A1 May 24, 2018

(51) Int. Cl.
*A61H 9/00* (2006.01)

(52) U.S. Cl.
CPC ... *A61H 9/0021* (2013.01); *A61H 2201/1669* (2013.01)

(58) Field of Classification Search
CPC ..... A61H 9/00; A61H 9/0021; A61H 9/0007; A61H 9/0028; A61H 9/0071; A61H 2009/0035; A61H 2009/0042
See application file for complete search history.

(56) References Cited

U.S. PATENT DOCUMENTS 4,853,988 A * 8/1989 Mutzell ..... A61H 23/04 4/615
4,976,256 A * 12/1990 Marlin ..... A61H 9/0021 5/670
5,540,651 A * 7/1996 Risch ..... A61H 9/0021 160/392
5,842,241 A * 12/1998 Cooper ..... A47C 27/085 5/670
6,139,512 A * 10/2000 Ricchio ..... A61H 23/04 4/541.4
6,210,351 B1 * 4/2001 Korenaga ..... A61H 9/0021 5/670
7,311,683 B2 * 12/2007 Turell ..... A61H 9/0071 601/157
7,998,098 B2 * 8/2011 Yang ..... A61H 39/04 601/134
8,348,871 B2 * 1/2013 Elliott ..... A61H 9/00 601/148
2004/0193077 A1 * 9/2004 Hsu ..... A61H 9/0071 601/49
2016/0206506 A1 * 7/2016 Henkemans ..... A61H 33/0087

* cited by examiner

*Primary Examiner* — LaToya M Louis
(74) *Attorney, Agent, or Firm* — Klaus J. Bach

(57) ABSTRACT

In a nozzle carrier drive for water let massaging apparatus a nozzle carriage which is movable along a guide track in the longitudinal direction of a tub of the water massaging apparatus and on which a nozzle for emitting a massaging water jet is disposed, a nozzle carriage drive arrangement is provided for independently moving the massaging water jet in the longitudinal and transverse directions of the tub by drive motors which are arranged outside the tub.

12 Claims, 3 Drawing Sheets

NOZZLE CARRIER DRIVE ARRANGEMENT FOR A WATER JET MASSAGING APPARATUS

BACKGROUND OF THE INVENTION

The invention concerns a nozzle support drive for water jet massaging apparatus.

Water jet massaging apparatus include a tub which is covered by a flexible support sheet for supporting a patient. The support sheet is in the form of a support foil which is stretched over the tub so as to form a support surface. In the interior of the tub, there is at least one nozzle carrier with a nozzle by which a massaging water jet is directed toward the support sheet providing for a dry water let massaging of a patient laying on the support sheet.

The at least one nozzle carrier is in the form of a nozzle carriage which is movable in the longitudinal direction of the tube along a guide structure. In most water massaging apparatus the nozzle carriage is driven along the tub by means of a motor-operated revolving pull belt, for example a toothed belt.

The nozzle disposed on the nozzle carriage is connected to a water pomp via a flexible hose for directing a massaging water jet from below toward the support sheet on which the patient is laying and which covers the tub.

In conventional water jet massaging apparatus, the nozzle is arranged on the nozzle carriage via a support structure which is movable relative to the nozzle carriage. It is arranged for example eccentrically on a driven rotating gear or on a sidewardly pivotable support arm so that the massaging water jet can be moved by the movement of the nozzle carrier in the longitudinal direction of the tub and, at the same time, also by the movement of the nozzle support structure in transverse direction of the tub. The drive for the nozzle movement can be provided by a motor which is arranged on the nozzle carriage or by elements which extended in the longitudinal direction within the tube such as a toothed rack in engagement with the gear supporting the nozzle, so that the nozzle movement in the transverse direction of the nozzle carrier movement is generated by the longitudinal movement of the nozzle carriage and is synchronized with the movement of the carriage or by a motor-driven device which causes the transverse movement of the nozzle carrier independently of the longitudinal movement of the nozzle carriage.

Examples of known water jet massaging apparatus with features as described are disclosed in EP X 54 3 809 A1, EP 0 880 958 D1, DE 20 2005 008 001 U1, DE 20 2004 018 984 U1, U.S. Pat. No. 4,757,808 and EP 2 327 386 B1.

All of these designs however have the disadvantage, that the nozzle carrier is relatively complicated since it requires several movable parts to provide for the movability of the nozzle and the nozzle drive. The known arrangements include partially also drive motors for the nozzle and/or the carriage which are arranged on the carriage or elsewhere within the tab. This is basically disadvantageous because the tub is always partially filled with a water supply from which the pump pumps water to the nozzle. The nozzle carriage is therefore always immersed with the complete moving mechanism in water and the presence of the many moving parts increases the susceptibility to wear and failures.

EP 1 666 017 B1 discloses an arrangement wherein a nozzle is arranged fixed on a nozzle carriage which is movable along a guide track that is pivotable back and forth about its longitudinal axis so that a sideward movement of the massaging jet is generated by pivot movement of the guide track and, as a result, the pivot movement of the nozzle carriage with the nozzle which is mounted thereon. This arrangement however, has the disadvantage that the nozzle jet during the sideward pivoting no longer impacts the bottom of the support sheet in a vertical direction but at an inclination angle which reduces the massaging effect. In addition, the longitudinal movement generating mechanism for the nozzle carriage has to participate in the pivot movement of the guide track about the longitudinal axis of the guide track which again requires a motor installed within the tub or a complicated drive mechanism.

It is the object of the present invention to provide a drive mechanism for a nozzle carriage from which the massaging water jet is always directed vertically upwardly toward the cover sheet but which, nevertheless, includes only a few movable parts.

SUMMARY OF THE INVENTION

In a nozzle carrier drive for water jet massaging apparatus comprising a nozzle carriage which is movable along a guide track in the longitudinal direction or a tub of the water massaging apparatus and on which a nozzle for emitting a massaging water jet is disposed, a nozzle carriage drive arrangement is provided for independently moving the massaging water jet in the longitudinal and transverse directions of the tub by drive motors which are arranged outside the tub.

In the arrangement according to the invention the nozzle carrier is of a simple design for reliable operation. The carriage may be slidably supported, or it may be movable on wheels or rollers. On the carriage, at least one nozzle is arranged fixed in place. Notwithstanding possibly provided support wheels for its support on a guide track, the carriage has no movable parts. The whole arrangement is solid and of a simple design. The transverse movement of the massaging water lets is independent of the longitudinal movement of the massaging water jet and therefore independently programmable and controllable. The drives for the longitudinal and the transverse movement of the nozzle may be arranged completely without the water-filled tub.

Exemplary embodiments of the invention will be described below in greater detail with reference to the accompanying drawings.

DESCRIPTION OF EXEMPLARY EMBODIMENTS

Figure 1:
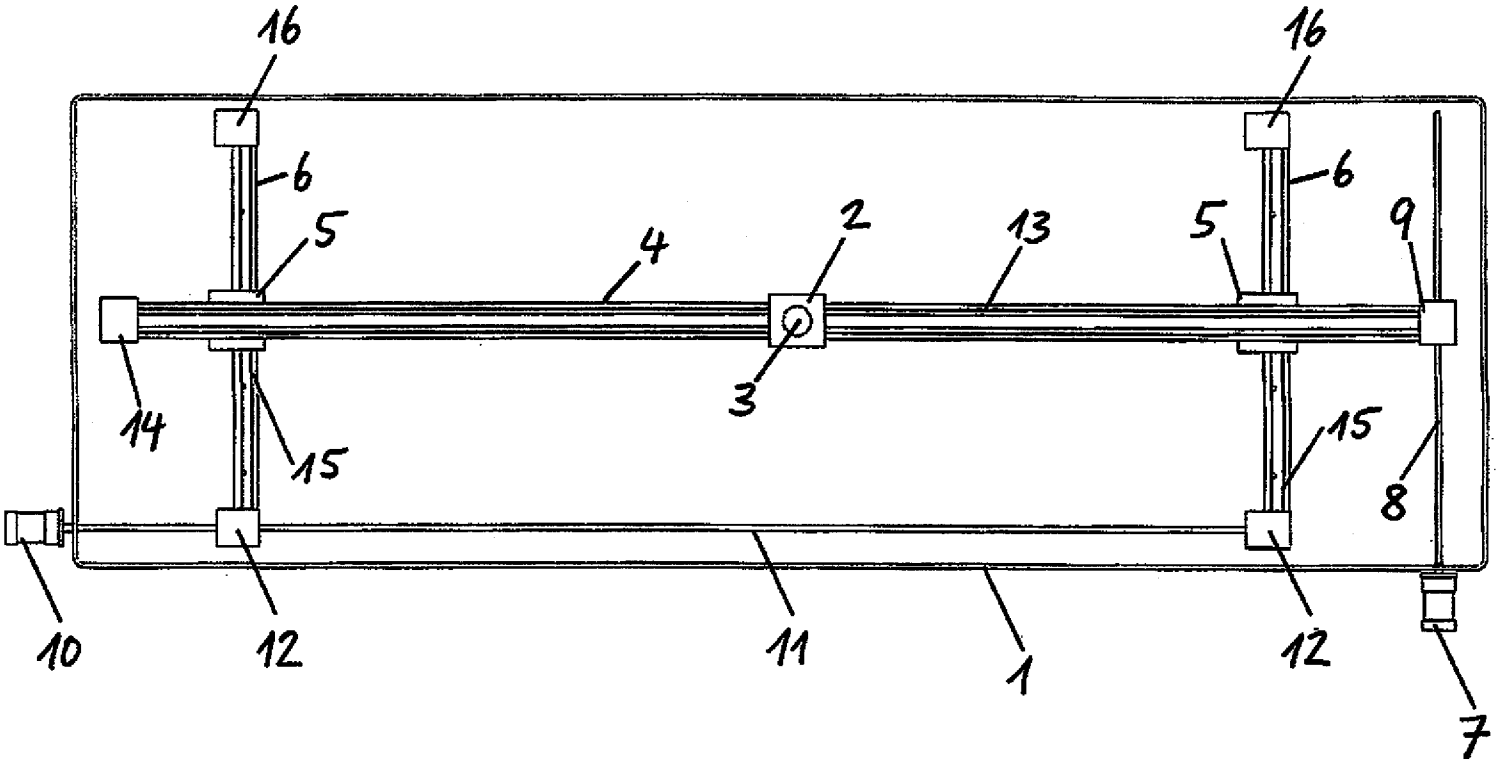
FIG. 1 is a schematic top view of a nozzle carriage drive arrangement of a water jet massaging device.
Figure 2:
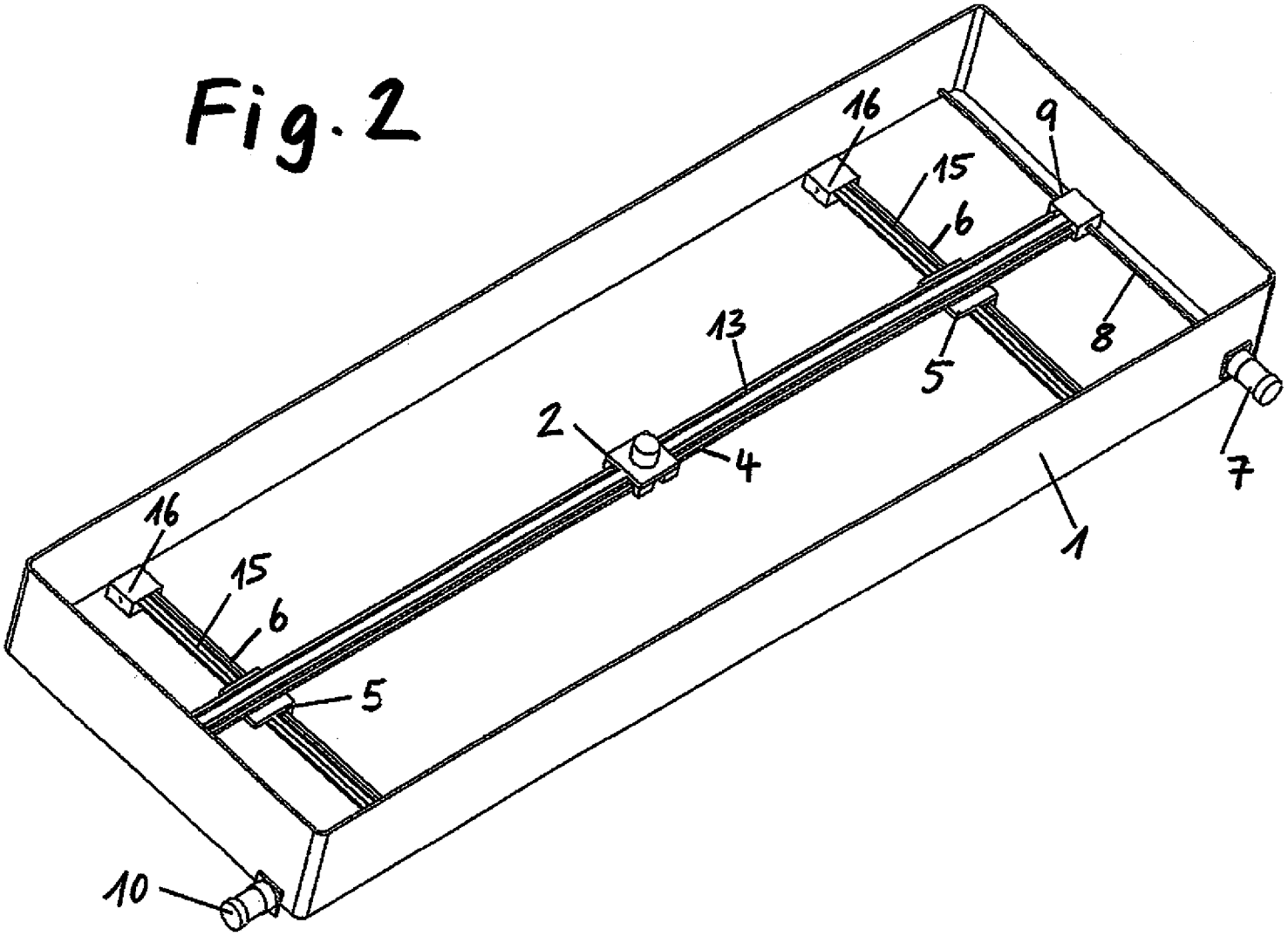
FIG. 2 shows the arrangement of FIG. 1 in an isometric perspective representation as seen at an angle from above.

In the following description, the designation "carriage" refers always to a sliding or wheel- or roller-supported embodiment of the carriage.

The figures show schematically a tub 1 of a water jet massaging apparatus and the nozzle carrier drive mechanism which is arranged in the area of the tub bottom within the tub for driving a nozzle support carriage 2. On the carriage 2, a nozzle 3 is rigidly supported and is connected, via a flexible hose which is not shown, to a pump for supplying water to the nozzle 3 for directing a water jet upwardly against a support sheet which is not shown but which closes the tube space at the top and serves as support foil for a patient.

The nozzle may be rigidly mounted to the nozzle carriage 2 but it may also be arranged movably, in particular, rotatably about its axis. The latter has the advantage that the hose attached thereto is subjected to less strain since the nozzle can then follow the angular movement of the hose during travel of the nozzle carriage 2.

The nozzle carriage 2 is movable along a guide track 4 extending in the longitudinal direction of the tub 1. The guide track 4 for the nozzle carriage is supported at its opposite end areas by two transverse carriages 5, which are each movably supported by a transverse track 6 extending transverse to the longitudinal direction of the tube 1.

In principle, a single transverse track 6 with a carriage 5 would be sufficient if it would be arranged centrally with respect to length of the guide track 4 and would be wide enough to firmly support the guide track 4.

The nozzle 3 arranged on the nozzle carriage 2 and, together therewith, the massaging water jet emitted from the nozzle 3 is movable by the movement of the nozzle carriage 2 along the guide track 4 in the longitudinal direction of the tub 1, and, at the same time, in a direction transverse to the longitudinal direction of the tub by a movement of the transverse carriages 5 which support the guide track 4 on the guide tracks 6 in the transverse direction of the tub.

The longitudinal movement, of the nozzle carriage 2 in the longitudinal direction of the tub is initiated by a drive motor 7 which is arranged outside the tub 1 and connected a transverse drive shaft 8 which extends transverse to the longitudinal direction of the tub. The transverse drive shaft 8 is presided, with a gear block 9 which is arranged at an end of the guide track 4 and is movable along the drive shaft 8 together with the guide track 4 in the transverse direction of the tub. The gear block 9 transmits the rotation of the drive shaft 8 to a longitudinal drive element 13 for the movement of the nozzle carriage 2 along the guide track 4.

The transverse movement of the nozzle carriage 2 is obtained by means of a drive motor 10 which is also arranged outside the tub I and which drives a longitudinal drive shaft 11 which extends in the longitudinal direction of the tub. Via fixed gear blocks 12, which are arranged at the ends of the fixed transverse tracks 6, the rotation of the longitudinal drive shaft 11 is converted to a synchronous movement of drive elements 15 for the transverse movement of the transverse carriages 5 which support the guide track 4.

The transverse drive shaft 8 and the longitudinal drive shaft 11 are preferably splined shafts but they may also be square shafts or other multi-edge shafts. The shafts may also be simple shafts which are provided in the areas of the drive blocks 9, 12 with a transmission element which is connected to, or formed from, the shaft for rotation therewith.

The drive element for the longitudinal movement of the nozzle carriage 2 may also be a revolving pull belt 13, which is connected to the nozzle carriage 2 and is driven via the gear block 9 and is redirected by redirecting block 14 arranged at the end of the guide track 4 opposite the gear block 9.

Similarly, the drive elements for the transverse carriage 5 may be pull belts 15 which are connected to the respective transverse carriages 5 and are driven by the respective gear blocks 12 and are redirected at the end of the transverse guide tracks opposite the gear blocks 12 by redirecting blocks 16, It is noted that instead of the pull belts 13, 15 other known means for the transfer of a drive movement from the respective drive blocks 9 or respectively 12 to the nozzle carriage 2 or, respectively the transverse carriages 5 may be used.

In the exemplary embodiment, only one nozzle carriage 2 is shown which is movable in the longitudinal and the transverse direction of the tub via a longitudinal guide track 4 supported on two transverse guide tracks 6 in the longitudinal and the transverse directions of the tub, wherein the nozzle carrier drive shown schematically in the drawings covers the whole tub bottom area. Alternatively, for example, two such arrangements may be arranged in the tub bottom area in parallel provided for two nozzle carriages, each provided with at least one nozzle and operating synchronously with, or independently of, each other.

It is also possible to design the exemplary embodiment of the shown arrangement in a 90° turned concept so that the nozzle carriage is movable on a transverse guide track in the transverse direction of the tub and the transverse guide track is movable via two longitudinal, carriages on two parallel longitudinal tracks in the longitudinal direction of the tub. Also in this case, in principle, a centrally arranged longitudinal carriage would be sufficient.

Figure 3:
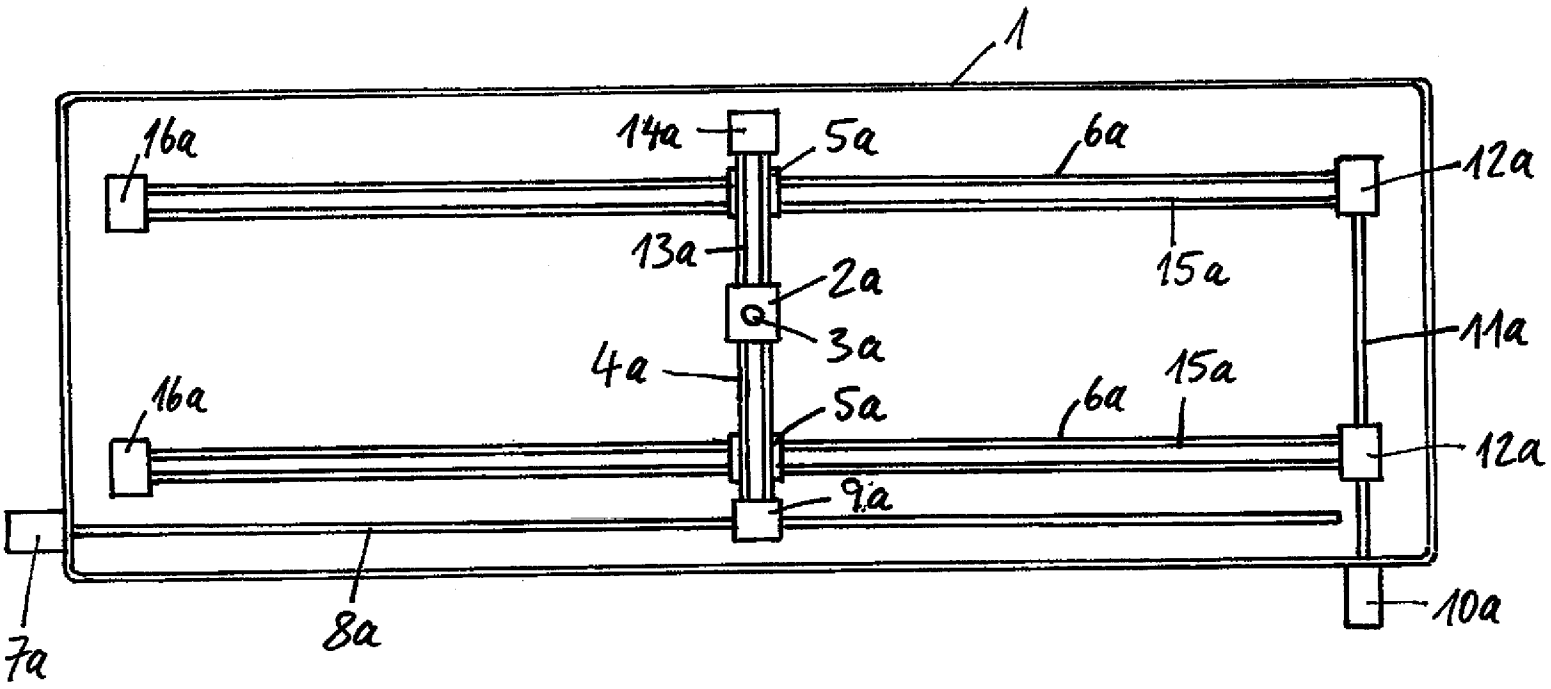
FIG. 3 shows an alternative nozzle carriage drive arrangement

In the alternative embodiment of the nozzle carrier drive arrangement for a jet massaging apparatus wherein the drive arrangement is essentially turned by 90° as shown in a top view in FIG. 3 which is similar to the representation of FIG. 1. Herein, the nozzle carriage 2*a* is provided with the nozzle 3*a* which is movably supported on a transverse track 4*a*. The transverse track which extends in a direction transverse to the longitudinal direction of the tub 1 is supported at its opposite ends by track support carriages 5*a*. The track support carriages 5*a* are movable in the longitudinal direction of the tub 1 along longitudinal tracks 6*a* disposed in the tub 1.

The movement of the water jet support carriage 2*a* in a direction transverse to the longitudinal extension of the tub 1 is provided for by a drive motor a which is arranged outside the tube 1. The drive motor 7*a* drives a longitudinal drive shaft 8*a* which transmits the rotation of the motor to a drive block 9*a* which is arranged at one end of the transverse track 4*a* and which transmits the rotation of the drive shaft 8*a* to a drive element 13*a* for moving the water jet nozzle carriage 2*a* in a direction transverse to the tub 1. If the drive element 13*a* is for example a pull belt drive, a reversing block 14*a* is arranged at the opposite end of the transverse track 4 a via which the pull belt is reversed.

What is claimed is:

1. A nozzle carrier drive arrangement for a water jet massaging apparatus comprising:

a tub with a longitudinal guide track provided with a nozzle carriage which is disposed in the tub and on which at least one nozzle for emitting a massaging water jet is disposed, and a drive arrangement for moving the massaging water jet in the longitudinal direction of the tub and transverse thereto, the at least one nozzle being arranged stationary on the nozzle carriage the nozzle carriage being movable in the longitudinal direction of the tub along the longitudinal guide track, the longitudinal guide track being supported by at least one transverse carriage which is movably supported on at least one transverse guide track disposed in the tub so as to extend transverse to the longitudinal direction of the tub a first drive motor with a first drive shaft extending transverse to the longitudinal direction of the tub which drive shaft drives a drive element connected to the nozzle carriage via a gear block arranged at one end of the longitudinal guide track for moving the nozzle carriage along the longitudinal guide track and a second drive motor with a second drive shaft which extends in the longitudinal direction of the tub and is connected to a drive element via a gear block arranged at one end of the transverse guide track, the drive element being connected to the transverse carriage for moving the longitudinal drive track together with the nozzle carriage in the transverse direction, wherein the first and second drive motors are arranged outside the tub.

2. The nozzle carrier drive arrangement according to claim 1, wherein the longitudinal guide track (4) is connected to two transverse carriages (5) which are spaced from each other along the guide track (4) and which are movable synchronously along the transverse tracks (6) extending in a direction transverse to the longitudinal direction of the tub (1).

3. The nozzle carrier drive arrangement according to claim 1, wherein the drive shafts are splined shafts.

4. The nozzle carrier drive arrangement according to claim 1, wherein the drive shafts are square shafts or other multi-edge shafts.

5. The nozzle carrier drive arrangement according to claim 1, wherein the drive elements are revolving pull belts, and wherein at the track end opposite the driving gear block in each case a reversing block (14, 16) for the respective pull belt is arranged.

6. The nozzle carrier drive arrangement according to claim 1, wherein the nozzle (3) is arranged on the nozzle carriage (2) so as to be rotatable about an axis thereof.

7. A nozzle carrier drive arrangement for a water jet massaging apparatus accommodated in a tub (1) and comprising;

a transverse guide track (4*a*) provided with a nozzle carriage (2*a*) provided with at least one nozzle (3*a*) arranged stationary on the nozzle carriage (2*a*) for emitting a massaging water jet supported on the transverse guide track (4*a*) so as to be movable along the transverse guide track (4*a*), and a drive arrangement (5, 6,15) for moving the massaging water jet carriage (2*a*) in a longitudinal direction transverse to the longitudinal direction of the tub (1) and transverse thereto, the transverse guide track (2*a*) being supported on at least one longitudinal carriage which is movable along a longitudinal guide track (6*a*) extending in the longitudinal direction of the tub (1), a first drive motor (7*a*) for driving a first drive shaft (8*a*) extending in the longitudinal direction of the tub (1), which first drive shaft (8*a*) extends through a drive element (9*a*) which is arranged at one end of the transverse guide track (4*a*) so as to be movable with the transverse guide track (4*a*) along the first drive shaft (8*a*) and which is operatively connected to the nozzle carriage (2*a*) via the gear element 9*a*), and a second drive motor (10*a*) for driving a second driveshaft (11*a*) extending in a direction transverse to the longitudinal direction of the tub (1) for driving, via a gear block (12*a*) arranged at the end of the longitudinal guide track (6*a*), a drive element (15*a*) that is connected to the longitudinal carriage (5*a*) supporting the transverse guide track (4*a*) with the nozzle carriage (2*a*) in the longitudinal direction of the tub (1), wherein the first and second drive motors are arranged outside the tub.

8. The nozzle carrier drive arrangement according to claim 7, wherein the transverse guide track (4*a*) is connected to two longitudinal carriages (5*a*) which are arranged each on one of two longitudinal guide tracks (6*a*) supported in the tub (1) in spaced relationship and which are movable synchronously along a longitudinal guide tracks (6*a*).

9. The nozzle carrier drive arrangement according to claim 7, wherein the drive shafts (8*a*, 11*a*) are splined shafts.

10. The nozzle carrier drive arrangement according to claim 7, wherein the drive shafts (8*a*, 11*a*) are square shafts or other multi-edge shafts.

11. The nozzle carrier drive arrangement according to claim 7, wherein the drive elements include revolving pull belts (13*a*, 5*a*), and wherein at the guide track end opposite the driving gear blocks (9*a*, 12*a*) in each case a reversing block (14*a*, 16*a*) for the respective pull belt (13*a*, 15*a*) is arranged.

12. The nozzle carrier drive arrangement according to claim 7, wherein the nozzle (3*a*) is arranged on the nozzle carriage (2*a*) so as to be rotatable about an axis thereof.

* * * * *